US007696431B2

(12) United States Patent
Chen et al.

(10) Patent No.: US 7,696,431 B2
(45) Date of Patent: Apr. 13, 2010

(54) DISTRIBUTION TERMINAL PEDESTAL SPADE FOR HARDWARE FREE ASSEMBLY

(75) Inventors: Simon Shen-Meng Chen, Palantine, IL (US); Jerome A. Maloney, Sugar Grove, IL (US); Eduardo Leon, Woodridge, IL (US); George I. Wakileh, Batavia, IL (US)

(73) Assignee: Emerson Network Power, Energy Systems, North America, Inc., Warrenville, IL (US)

( * ) Notice: Subject to any disclaimer, the term of this patent is extended or adjusted under 35 U.S.C. 154(b) by 0 days.

(21) Appl. No.: 12/215,125

(22) Filed: Jun. 25, 2008

(65) Prior Publication Data

US 2008/0258020 A1 Oct. 23, 2008

Related U.S. Application Data

(63) Continuation-in-part of application No. 11/733,895, filed on Apr. 11, 2007, now Pat. No. 7,569,768.

(60) Provisional application No. 61/057,573, filed on May 30, 2008.

(51) Int. Cl.
*H02G 9/00* (2006.01)

(52) U.S. Cl. ..... 174/38; 174/37; 174/39; 52/3; 138/112

(58) Field of Classification Search ..... 174/37, 174/38, 39, 58, 59, 40, 17 R; 138/11, 112, 138/115, 111; 312/263, 223.6, 265.5; 220/3.3, 220/3.8, 475, 484, 669, 672; 52/3; 70/63
See application file for complete search history.

(56) References Cited

U.S. PATENT DOCUMENTS

| | | | | |
|---|---|---|---|---|
| 3,485,932 | A * | 12/1969 | Van Schaack | 174/38 |
| 3,652,779 | A * | 3/1972 | Grinols | 174/38 |
| 3,812,279 | A * | 5/1974 | Voegeli | 174/38 |
| 3,868,474 | A | 2/1975 | Bunten | |
| 4,058,670 | A | 11/1977 | Leschinger | |
| 5,384,427 | A | 1/1995 | Volk et al. | |
| 6,598,949 | B2 | 7/2003 | Frazier et al. | |
| 7,357,009 | B2 * | 4/2008 | Maloney et al. | 70/169 |

* cited by examiner

*Primary Examiner*—Dhiru R Patel
(74) *Attorney, Agent, or Firm*—Harness, Dickey & Pierce, P.L.C.

(57) ABSTRACT

A spade or stake for hardware free mounting to a telecommunications data distribution terminal pedestal is disclosed. The spade may include one or more connectors of various types for engaging the pedestal to thereby couple the spade to the pedestal without hardware, and thus without tools. The pedestal may also include one or more connectors for mating with corresponding connectors on the stake.

30 Claims, 10 Drawing Sheets

DISTRIBUTION TERMINAL PEDESTAL SPADE FOR HARDWARE FREE ASSEMBLY

CROSS-REFERENCE TO RELATED APPLICATIONS

This application is a continuation-in-part of U.S. patent application Ser. No. 11/733,895 filed Apr. 11, 2007, now U.S. Pat. No. 7,569,768 and claims the benefit of U.S. Provisional Application No. 61/057,573 filed May 30, 2008. The entire disclosures of the above-referenced applications are incorporated herein by reference.

FIELD

The present teachings relate to spades for hardware free mounting to outdoor data distribution terminal pedestals.

BACKGROUND

The statements in this section merely provide background information related to the present disclosure and may not constitute prior art.

A primary concern among data communication service providers today is the amount of time and resources required to install and use outside plant data communication equipment such as distribution terminal pedestals. Distribution terminal pedestals are utilized to provide a housed connection point for passive, i.e., non-powered, type connections. For example, distribution terminal pedestals can be utilized to house the connection points of one or more telecommunication central transmission lines to one or more customer service transmission lines. The pedestals generally protect the connection points from various environmental factors, tampering, etc., but can also be opened to allow access by a service person.

At least some known distribution terminal pedestals include a one-piece dome attached to a two-piece base, in which various passive connections can be made. The two-piece base is typically coupled together using hardware, such as nuts and bolts, retaining clips and screws, etc. Additionally, often a spade or stake can be attached to the base to add additional stability to the pedestal when placed in the ground. In such cases, the spade or stake is either integrally formed with one-half of the base or attached to the base using hardware.

Furthermore, initial installation of such pedestals, and subsequent access to the passive connections housed within, typically require the use of tools to fasten and unfasten the hardware coupling the components together. Thus, the requirement of hardware to couple the components together adds considerable parts and labor costs to the installation and servicing of such known pedestals.

SUMMARY

According to one aspect of the present disclosure, a spade or stake is configured for hardware free mounting to a telecommunications data distribution terminal pedestal. The spade may include one or more connectors of various types for engaging the pedestal to thereby couple the spade to the pedestal without hardware, and thus without tools. The pedestal may also include one or more connectors for mating with corresponding connectors on the spade.

Further areas of applicability of the present teachings will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

Figure 5A:
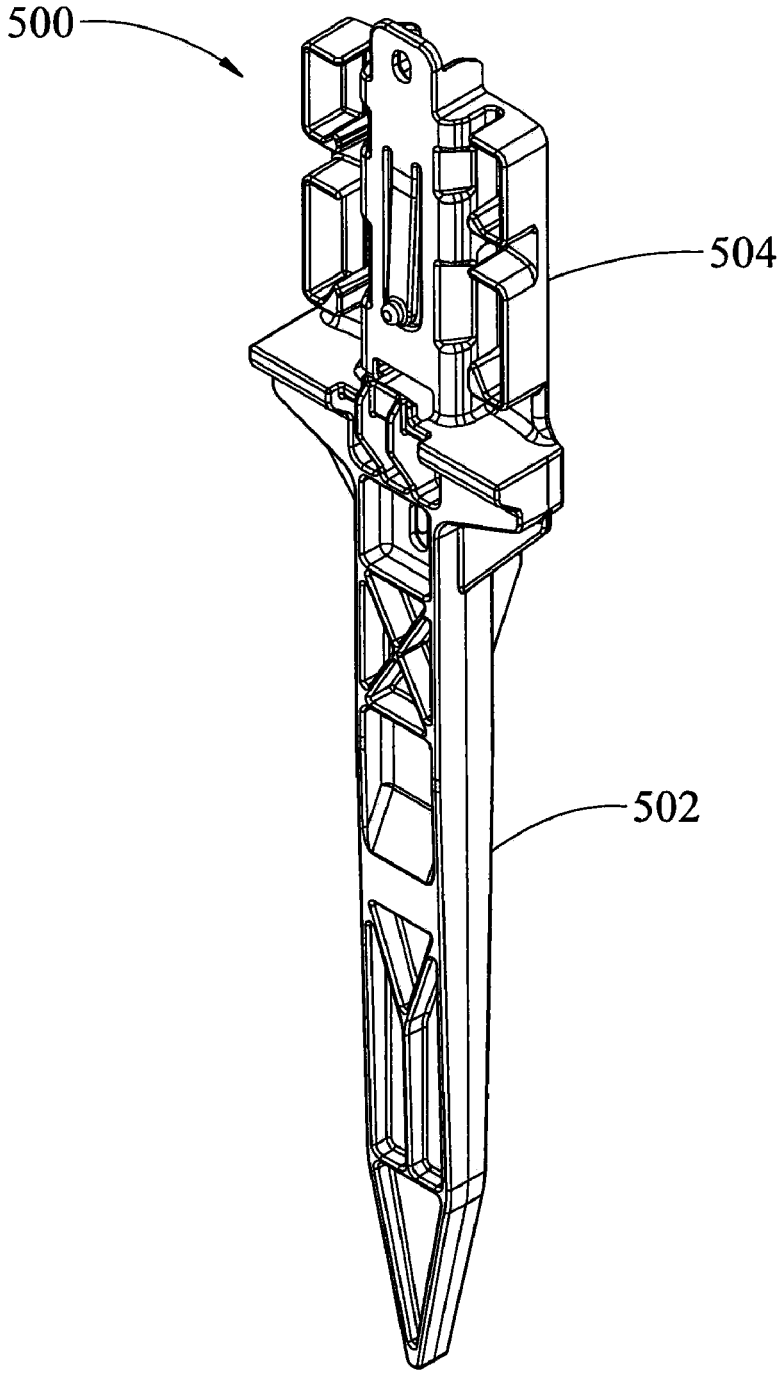

FIG. 5*a* is a front isometric view of a spade for hardware free mounting to a pedestal base according to various embodiments of the present disclosure.

Figure 5B:
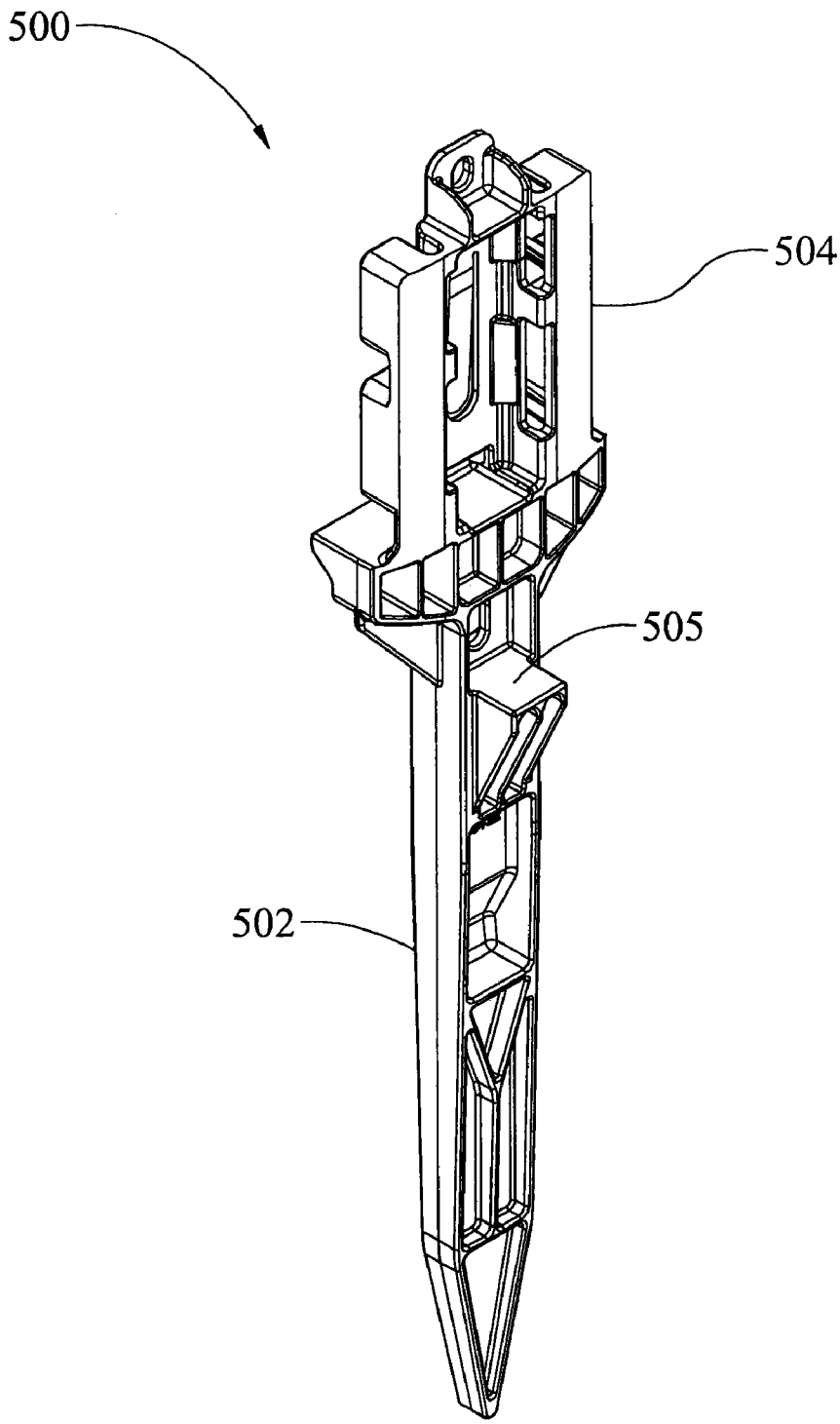

FIG. 5*b* is a rear isometric view of the spade of FIG. 5*a*.

Figure 6A:
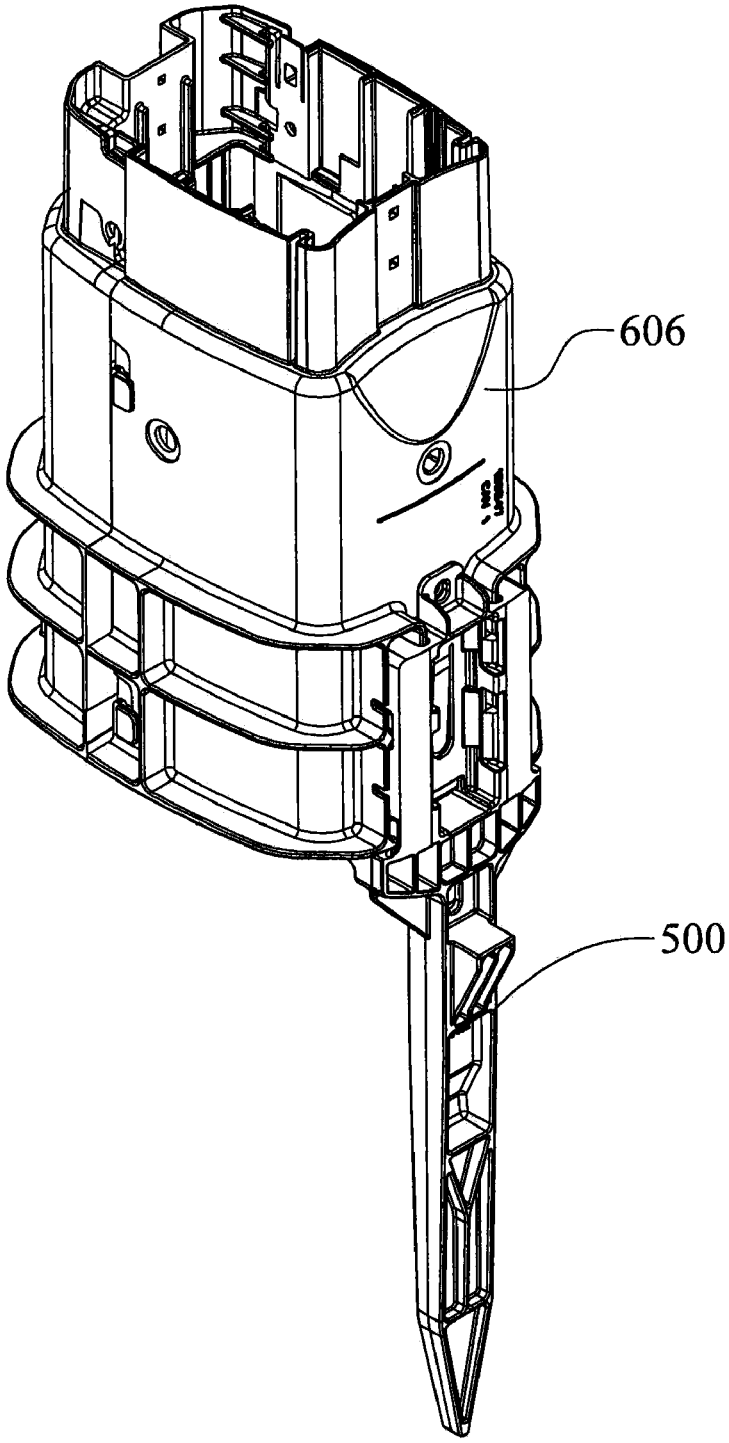

FIG. 6*a* is an isometric view of a distribution terminal pedestal base with the spade shown in FIGS. 5*a* and 5*b* mounted thereto.

Figure 6B:
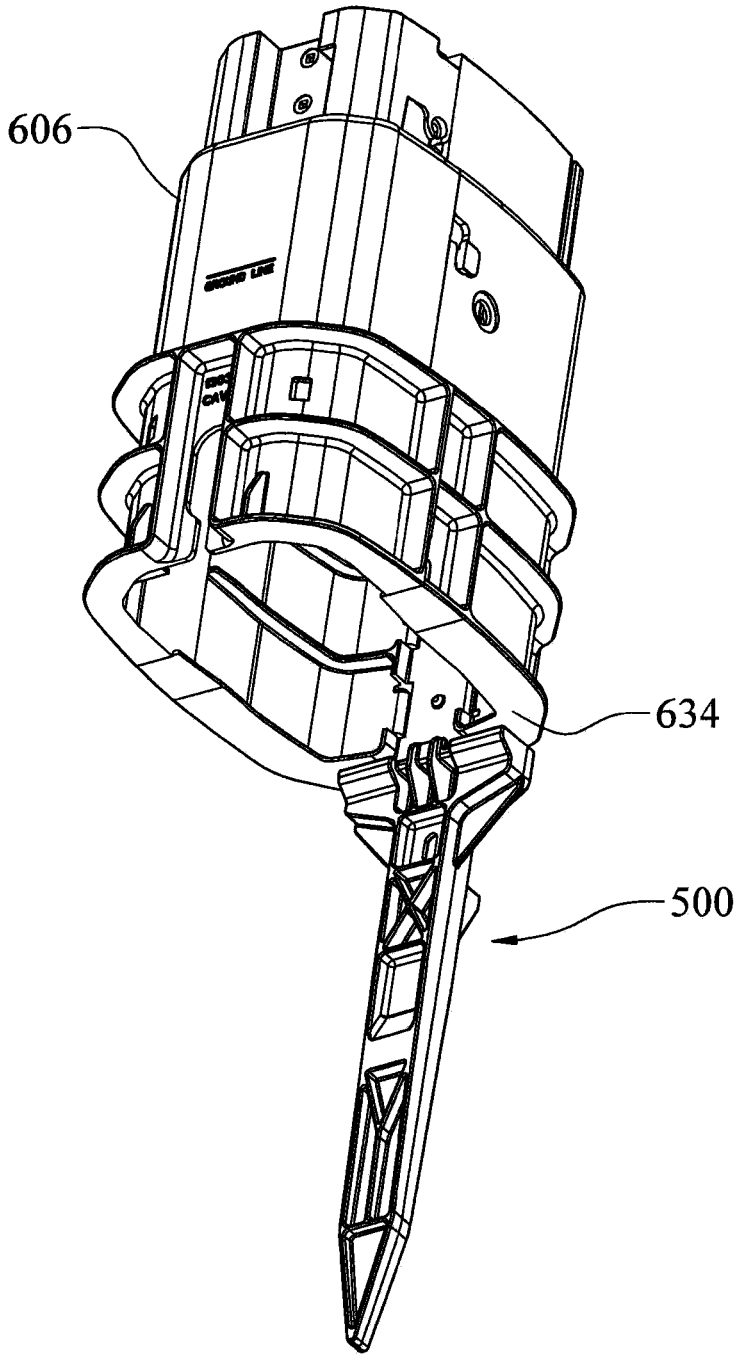

FIG. 6*b* is another isometric view of the distribution terminal pedestal base of FIG. 6*a*.

Figure 7:
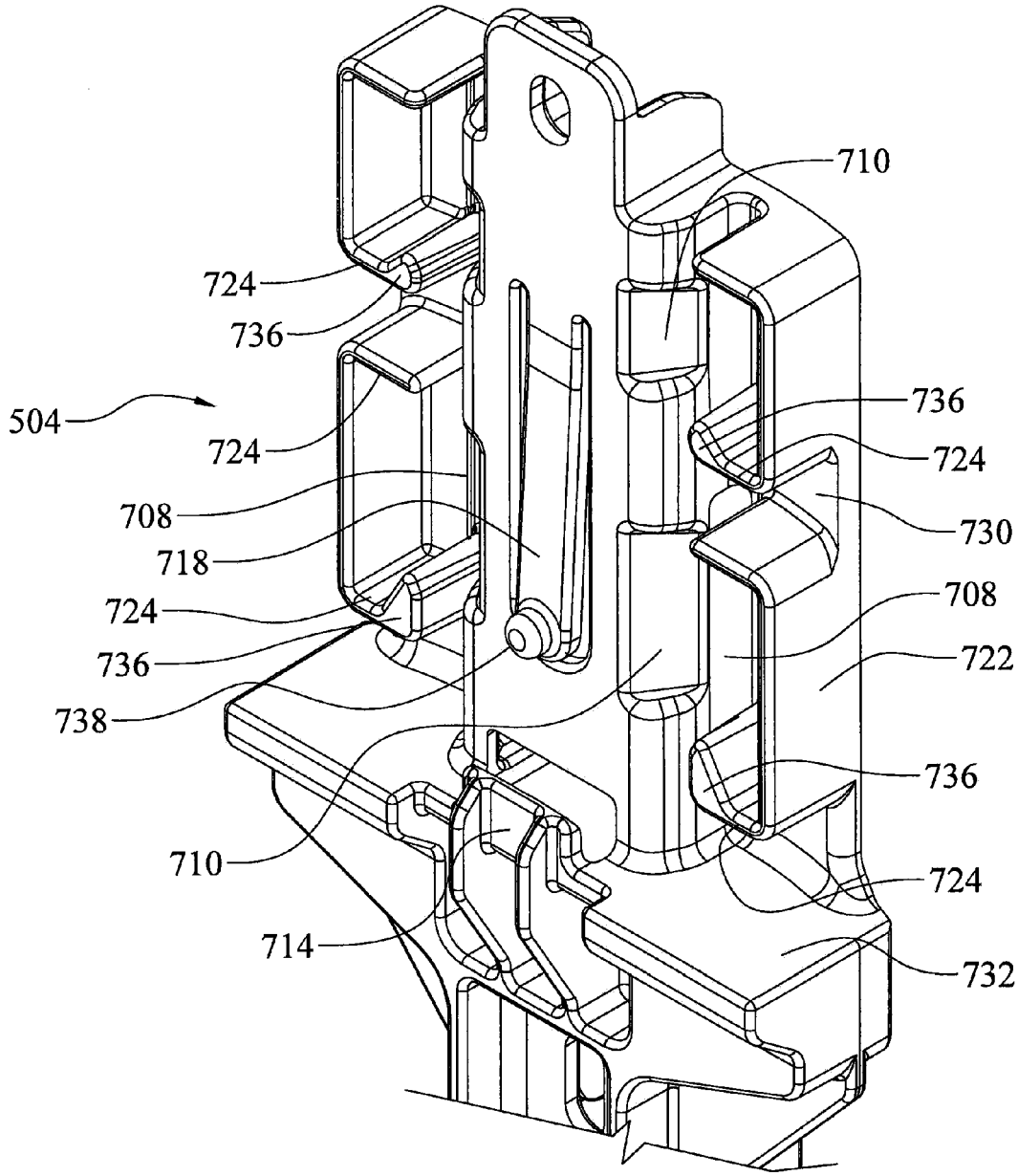

FIG. 7 is an enlarged view of a portion of the spade of FIG. 5*a*.

Figure 8:
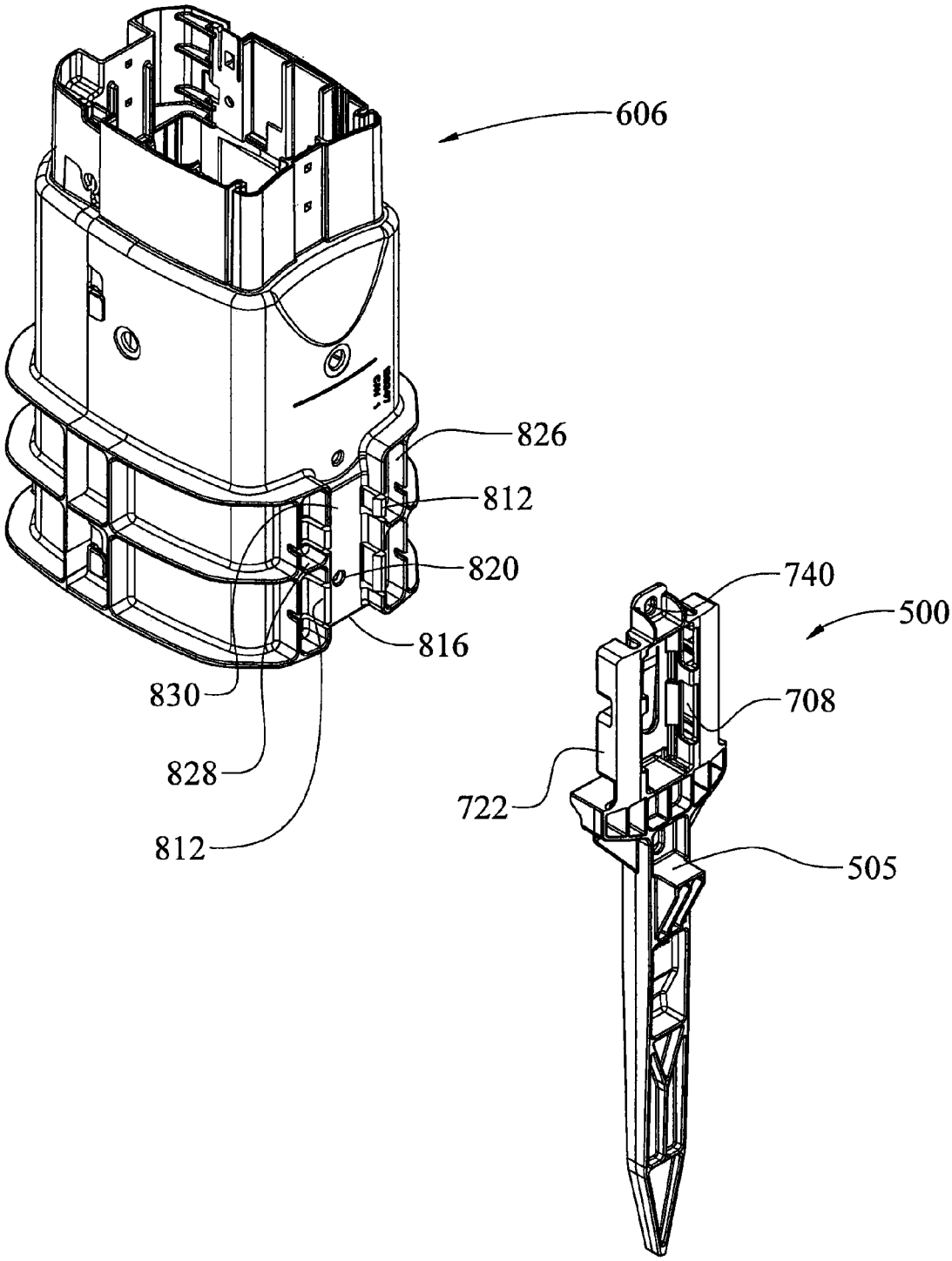

FIG. 8 is an exploded isometric view of the distribution terminal pedestal base and spade shown in FIG. 6*a*.

DETAILED DESCRIPTION

The following description is merely exemplary in nature and is in no way intended to limit the present teachings, application, or uses. Throughout this specification, like reference numerals will be used to refer to like elements.

Figure 1:
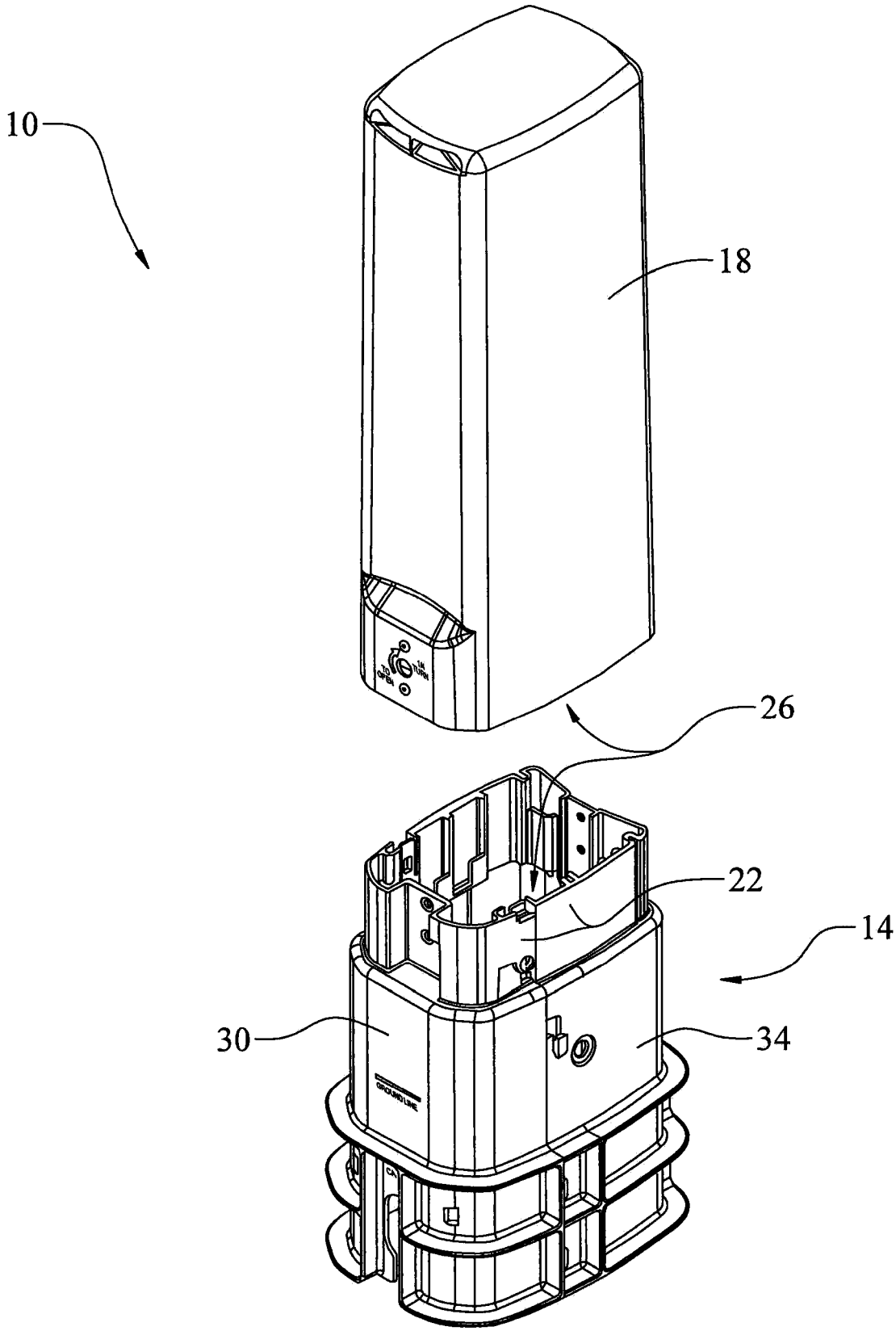
FIG. 1 is an exploded isometric view of a data distribution terminal pedestal, in accordance with various embodiments of the present invention.

Referring to FIG. 1, a data distribution terminal pedestal 10 is provided, in accordance with various embodiments of the present disclosure. For simplicity and clarity the data distribution terminal pedestal 10, will be referred to herein simply as the pedestal 10. The pedestal 10 generally includes a two-piece, assembly hardware free base 14 and a top cover 18 that fits over a reduced dimensioned top portion 22 of the base 14 to form an enclosed interior chamber 26. The two-piece, assembly hardware free base 14 includes a first wall structure 30 and a second wall structure 34 that are interlockingly connectable to form the base 14. Specifically, the first and second wall structures 30 and 34 are structured, or formed, to couple together such that the base 14 can be assembled and form the interior chamber 26 without the use of assembly hardware. More specifically, as described further below, the base 14 can be assembled on-site by coupling together the first and second wall structures 30 and 34 without the use of assembly hardware or related tools.

As used herein, assembly hardware includes any separate, independent, stand-alone fastening device or mechanism used to couple together two or more components, parts or structures, e.g., components of known data distribution terminal pedestals. Also, as used herein, tools include any hand-held tool used to install such assembly hardware. For example, assembly hardware can include screws, nuts and bolts, rivets, push-in plugs or pins, etc., and the associated tools can include screw drivers, drills, screw guns, rivet guns, wrenches, nut drivers, etc.

In various implementations, the pedestal 10 can be utilized to protect connection points of one or more main, or central, data distribution cables with one or more service lines to customer locations. Typically, such main distribution cables and service lines are run underground to a desired location where they are brought above ground and terminated. The base 14 can be quickly and easily assembled on-site, absent assembly hardware, and partially buried in the ground around the terminal ends of the main cables and service lines. Thus, the terminal ends of the main cables and service lines are enclosed within the interior chamber 26, which can include any interior area of the top cover 18 that may exist above the base 14 when the top cover 18 is coupled to the base 14. Any and all desired connections between the terminal ends of the main cables and service lines can then be made and the top cover 18 installed to enclose the connections. Thus, the connections are disposed within the interior chamber 26 and protected from weather, contaminates, tampering, vandalism, etc.

Figure 2:
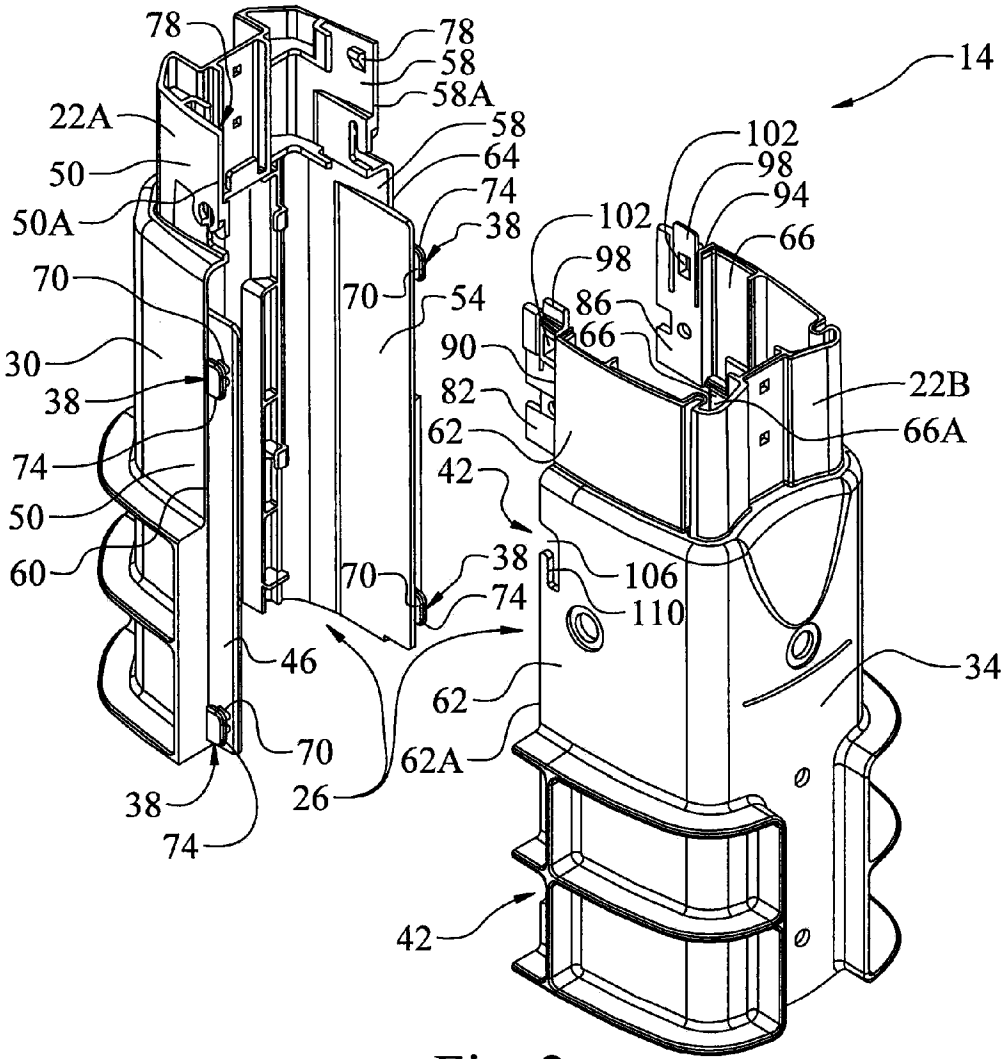
FIG. 2 is an exploded isometric view of a data distribution terminal pedestal base, in accordance with various embodiments of the present disclosure.

FIG. 2 is an exemplary illustration of the base 14, in accordance with various embodiments. As described above, the base 14 includes the first and second wall structures 30 and 34 that can be coupled together, absent assembly hardware, to form the base 14. More particularly, the first and second wall structures 30 and 34 are interlockingly connectable via integrally formed latching buttons 38 that interlockingly mate with corresponding integrally formed interlocking slots 42.

As illustrated, the first wall structure 30 includes a first longitudinal tongue 46 extending along a first longitudinal edge portion 50 of the base first wall structure 30. The first wall structure 30 additionally includes an opposing second longitudinal tongue 54 extending along an opposing second longitudinal edge portion 58 of the base first wall structure 30. More specifically, the first and second longitudinal tongues 46 and 54 extend from and are coplanar with an interior side of the respective first and second longitudinal edge portions 50 and 58. Accordingly, the first longitudinal tongue 46 forms a first lip 60 with the first longitudinal edge portion 50, and the second longitudinal tongue 54 forms a second lip 64 with the second longitudinal edge portion 58.

Integrally formed with and extending substantially orthogonally from each of the first and second longitudinal tongues 46 and 54 are one or more latching buttons 38. Correspondingly, the second wall structure 34 includes at least one interlocking slot 42 integrally formed within a first longitudinal edge portion 62 and at least one interlocking slot 42 integrally formed within a second longitudinal edge portion 66. The number and location of the interlocking slots 42 are such that for each latching button 38 there is a corresponding interlocking slot 42 within the respective first and second edge portions 62 and 66 of the second wall structure 34. Additionally, although the one or more interlocking slots 42 integrally formed within the second longitudinal edge portion 66 are obscured from view in FIG. 2, one skilled in the art would easily and readily understand that the second longitudinal edge portion 66 and one or more integrally formed interlocking slots 42 are substantially a mirror image of the first longitudinal edge portion 62 and integrally formed interlocking slots 42, clearly illustrated in FIG. 2.

Figure 3:
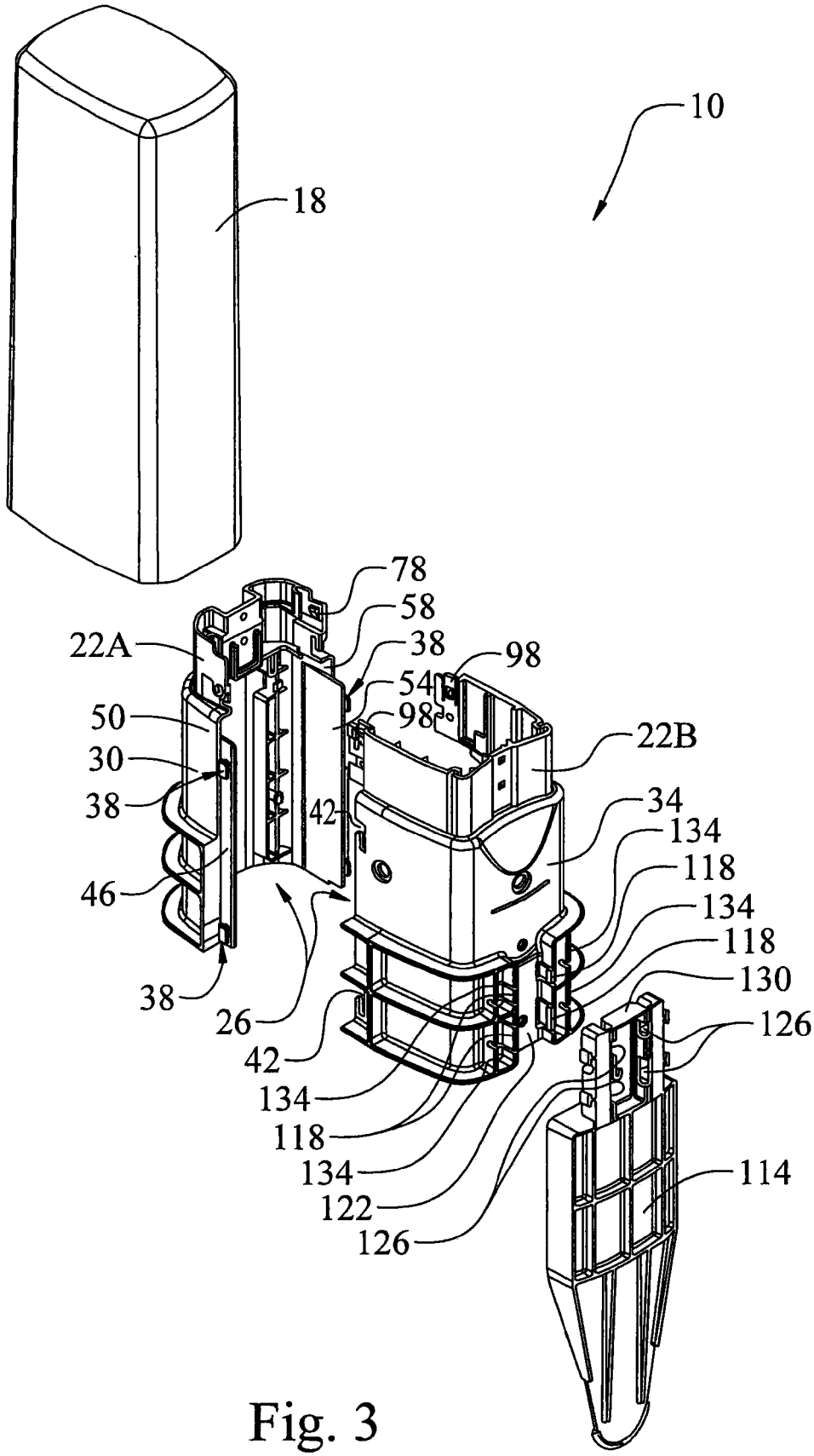
FIG. 3 is an exploded isometric view of a data distribution terminal pedestal including a base and an auxiliary stability spade, in accordance with various embodiments of the present disclosure.

Although, as described above, the base first and second wall structures 30 and 34 can respectively include one or more of the latching buttons 38 and corresponding interlocking slots 42, FIGS. 2 and 3 exemplarily illustrate a plurality of each of the latching buttons 38 and corresponding interlocking slots 42. Accordingly, for simplicity and clarity the one or more latching buttons 38 and the one or more interlocking slots 42 will be referred to hereafter in the plurality.

Each latching button 38 includes a stem 70 integrally formed with and extending substantially orthogonally from the respective longitudinal tongue 46 and 54. Each latching button 38 additionally includes a cap 74 integrally formed at a distal end of the stem 70. The caps 74 are generally flat and extend substantially orthogonally from a longitudinal axis of the stems 70 such that a profile of the latching buttons 38 has substantially a 'T' shape. The stem 70 of each latching button 38 is sized to fit within the corresponding interlocking slot 42. Additionally, each latching button 38 is formed such that a longitudinal length of each stem 70 is substantially equal to, or slightly greater than, a thickness of respective first and second edge portions 62 and 66 of the second wall structure 34.

With further reference to FIG. 2, as described above, the two-piece, assembly hardware free base 14 includes a reduced dimensioned top portion 22. More specifically, the first wall structure 30 includes a reduced dimensioned top portion 22A and the second wall structure 34 includes a reduced dimensioned top portion 22B. As readily understood by one skilled in the art, when the first and second wall structures 30 and 34 are coupled together, as described below, reduced dimensioned top portions 22A and 22B combine to form the reduced top portion 22.

In accordance with various embodiments, the first wall structure 30 includes a pair of latching bosses 78 integrally formed with an interior surface of the first wall structure top portion 22A. Specifically, one latching boss 78 is formed with the top portion 22A interior surface along the first longitudinal edge portion 50, and the second latching boss 78 is formed with the top portion 22A interior surface along the second longitudinal edge portion 58. Although the latching boss 78 integrally formed with the interior surface of the first longitudinal edge portion 50 is obscured from view in FIG. 2, one skilled in the art would easily and readily understand that particular latching boss 78 is substantially a mirror image of the latching boss 78 integrally formed with the interior surface of the second longitudinal edge portion 58, clearly illustrated in FIG. 2.

The second wall structure 34 additionally includes a first longitudinal shoulder 82 extending from the top portion 22B along the first longitudinal edge portion 62, and a second longitudinal shoulder 86 extending from the top portion 22B along the second longitudinal edge portion 66. More specifically, the first and second longitudinal shoulders 82 and 86 extend from and are coplanar with an interior side of the top portion 22B. Accordingly, the first longitudinal shoulder 82 forms a first offset 90 with the first longitudinal edge portion 50, and the second longitudinal shoulder 86 forms a second offset 94 with the second longitudinal edge portion 58.

The first and second longitudinal shoulders 78 and 82 each have integrally formed therein a biased latching tab 98. Each latching tab 98 includes a retention aperture 102 and corresponds to a respective one of the latching bosses 78 of first wall structure 30. The retention apertures 102 are sized to receive and engage the respective corresponding latching boss 78 when the first and second wall structures 30 and 34 are coupled together, as described below. As illustrated in FIG. 2, in various embodiments, the biased latching tabs 98 are integrally formed, e.g., molded, within the top portion 22B of the second wall structure 34. Accordingly, the biased latching tabs 98 are biased to an upright position, as illustrated, or slightly inward toward the interior chamber 26, by their integral formation with the top portion 22B. However, in other various embodiments, the biased latching tabs 98 can be biased to the upright, or slightly inward, position, using any suitable biasing devices, such as a coil or leaf spring. In such embodiments, the biasing devices can be utilized to supplement the biasing force provided by integrally forming the latching tabs 98 with the top portion 22B. Or, the biasing devices can be further used to connect the latching tabs 98 to the top portion 22B.

To assemble the base 14, i.e., interlockingly couple the first and second wall structures 30 and 34 together absent assembly hardware, the latching buttons 38 are interlockingly mated with the corresponding interlocking slots 42. More particularly, in various embodiments, the interlocking slots 42 generally have an 'L' shape and include a mouth 106 and a locking leg 110. Therefore, the stems 70 of each latching button 38 can be inserted into the mouth 106 of the corresponding 'L' shaped interlocking slot 42. The first and second wall structures 30 and 34 can then be moved longitudinally with respect to each other such that the stems 70 are moved into interlocking slot legs 110. Thus, the latching buttons 38 are interlockingly mated with the interlocking slots 42 to interlockingly couple the first and second wall structures 30 and 34 together, forming the base 14 absent assembly hardware.

Additionally, when the latching button stems 70 are fully inserted into interlocking slot mouths 106, leading edges 62A and 66A of the respective second wall structure first and second edge portions 62 and 66 substantially abut the first and second lips 60 and 64 of the first wall structure 30. Similarly, leading edges 50A and 58A of the respective first and second edge portions 50 and 58, at first wall structure top portion 22A, substantially abut the first and second offsets 90 and 94 of the second wall structure top portion 22B. In this position, prior to interlocking the stems 70 within the interlocking slot legs 110, the latching bosses 78 are located below, and aligned with, the biased latching tab apertures 98. Therefore, when one or both of the first and second wall structures 30 and 34 are longitudinally moved with respect to each other to interlocking mate the latching buttons 38 with the interlocking slots 42, the latching bosses are engaged within the respective latching tab apertures 102. Particularly, as the first and second wall structures 30 and 34 are longitudinally moved with respect to each other, the latching tabs 98 are cammed over the latching bosses 78. When the latching button stems 70 approach, or hit, the bottom of the respective interlocking slot legs 110, the latching bosses 78 are generally centered with respective latching tab apertures 110. The biased nature of the latching tabs 98 then forces the latching tabs 98 inward, toward the interior chamber 26, to thereby engage the latching bosses 78 within the respective latching tab apertures 98. Engaging the latching bosses 78 within the respective latching tab apertures 98 substantially retains the interlocked engagement of latching buttons 38 within the latching slot 42.

Furthermore, as the first and second wall structures 30 and 34 are moved together to insert latching button stems 70 into the interlocking slots 42, the first and second longitudinal tongues 46 and 54 slide along the interior surfaces of the second wall structure first and second longitudinal edge portions 62 and 66. Similarly, as the first and second wall structures 30 and 34 are moved together, the first and second longitudinal shoulders 82 and 86 slide along the interior surfaces of the first wall structure first and second longitudinal edge portions 50 and 58, at the top portion 22A. This interlocking alignment of the first and second longitudinal tongue portions and shoulders 46, 54, 82 and 86 with the respective edge portions 62, 66, 50 and 58, aids in aligning the first and second wall structures 30 and 34 during assembly and provides structural stability of the assembled base 14.

In various embodiments, the interlocking slot legs 110 can be formed such that each leg is slightly canted away from the respective leading edges 62A and 66A. Accordingly, as the first and second wall structures 30 and 34 are moved longitudinally with respect to each other and the stems 70 are moved into interlocking slot legs 110, the canting of the legs 110 cause the wall structures 30 and 34 to be pulled toward each other. Therefore, the leading edges 50A, 58A, 62A and 66A, of the respective first and second wall structures 30 and 34, will be pulled into firm abutment with the respective lips 60 and 64 and offsets 90 and 94 of the respective opposing first and second wall structures 30 and 34.

To access the lower portion of interior chamber 26 after the base 14 has been assembled, as described above, the first and second wall structures 30 and 34 can be easily separated by disengaging the latching tabs 98 and lifting up on the first wall structure 30. More specifically, to separate the first and second wall structures 30 and 34, the latching tabs 98 can be pushed outwardly, away from the interior chamber 26 to disengage the latching bosses 78. With the latching tabs 98 disengaged, one or both of the first and second wall structures 30 and 34 can be longitudinally moved with respect to each other such that the latching buttons 38 are moved toward the latching slot mouths 106. The first and second wall structures 30 and 34 can then be separated to provide access to the lower portion of the interior chamber 26.

Figure 4:
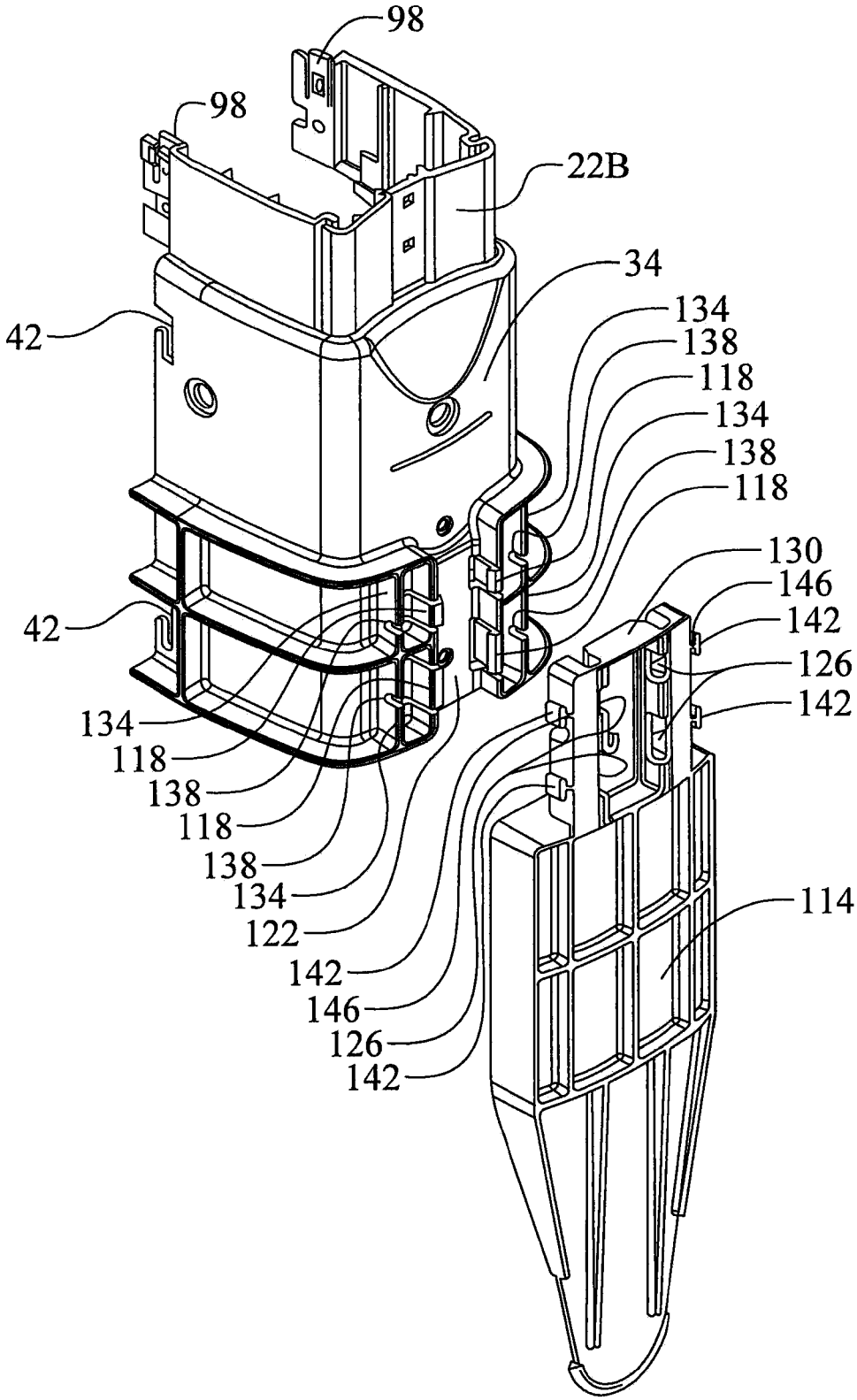
FIG. 4 is an enlarged view of a portion of FIG. 3 illustrating an interconnection of the base and the auxiliary stability spade, in accordance with various embodiments of the present disclosure.

Referring now to FIGS. 3 and 4, in various embodiments the pedestal 10 can include an auxiliary stability spade 114 that can be fixedly connected, or coupled, to either the first or the second wall structure 30 or 34 without the use of assembly hardware. The stability spade 114 can be coupled to the base 14 to provide additional ground stability to the pedestal 10 when the pedestal 10 is installed in areas where the terrain is softer, e.g., beach areas. Although FIGS. 3 and 4 illustrate the stability spade 114 as being fixedly connectable to the second wall structure 34, and will be described herein as such, it should be readily understood that in other embodiments the stability spade 114 can be equally connectable to the first wall structure 30 in the same manner as described herein with regard to FIGS. 3 and 4.

More particularly, in various embodiments, the second wall structure 34 is structured to include a plurality of biased latching fingers 118. The biased latching fingers 118 are integrally formed with and extend substantially orthogonally from an outer surface of a bottom portion 122 of the second wall structure 34. Additionally, the stability spade 114 includes a plurality of latching windows 126 formed within a proximal end portion 130 of the stability spade 114. Each latching window 126 is sized to receive a corresponding one of the latching fingers 118. To fixedly couple the stability spade 114 to the wall structure 34, absent assembly hardware, the stability spade 114 is pressed against the wall structure bottom portion 130 such that biased latching fingers 118 are engaged within the latching windows 126. The biased latching fingers 118 and corresponding latching windows 126 are structured, or formed, so that latching fingers 118 firmly engage the latching windows 126. Therefore, the stability spade 114 is fixedly mounted to the wall structure 34 and can not be easily removed or dislodged.

As illustrated in FIGS. 3 and 4, in various embodiments, the biased latching fingers 118 are integrally formed, e.g., molded, within the bottom portion 122 of the second wall structure 34. Accordingly, the biased latching fingers 118 are biased to an upright or slightly inward position by their integral formation with the bottom portion 122.

In various embodiments, the second wall structure 34 includes a plurality of raised ribs 134 that include at least one alignment and support slot 138. Additionally, the stability spade 114 includes at least one T-tab 142 structured to mate with a respective one of the alignment and support slots 138 when the stability spade 114 is fixedly connected to the second wall structure 34, as described above. Specifically, a neck 146 of each T-tab 142 is sized to slide into the corresponding alignment and support slot 138 as the stability spade proximal end portion 130 is being pressed against the second wall structure bottom portion 122 to fixedly engage the latching fingers 118 with the latching windows 126. The alignment and support slots 138 and T-tabs 142 aid in aligning the stability spade 114 during assembly and provide structural stability of the stability spade 114 when placed in the ground.

Although FIGS. 3 and 4, and the description above, provide that the latching fingers 118 are formed with the second wall structure 34 and the latching windows 126 are formed within the stability spade 114, the reverse could be the case and remain within the scope of the present disclosure. That is, the latching fingers 118 could be formed with stability spade 114 and the latching windows 126 formed within the structure of the second wall structure bottom portion 122, and remain within the scope of the present disclosure.

Another embodiment of a stability spade 500 for hardware free mounting to a telecommunications distribution terminal pedestal will now be described with reference to FIGS. 5*a*-8. As shown in FIGS. 5*a* and 5*b*, the spade 500 includes a lower section 502 for insertion into ground and an upper section 504 for coupling the spade 500 to a pedestal.

As best shown in FIG. 5*b*, the spade 500 includes a drive surface 505 on the lower section 502. The drive surface 505 provides a surface to which a force may be applied to drive the lower section 502 into the ground after the spade 500 is attached to a pedestal base. The installer may use a tool, such as a hammer, to apply the driving force or may apply the driving force to the drive surface 505 with his or her foot. In addition to providing a surface for the application of a driving force, the drive surface can make it more difficult to remove the spade 500 from the ground after it has been driven into the ground. This provides additional stability to a pedestal to which the spade 500 is attached.

As illustrated in FIGS. 6*a* and 6*b*, the stability spade 500 (also referred to as a stake) is configured for coupling to a base 606 of a telecommunications pedestal. As with the spade 114 described above, the spade 500 can be used with any base, i.e., a one piece base, a two piece base, a plastic base, a metal base, etc., that is suitably configured to accept the spade 500.

As best shown in FIGS. 7 and 8, the spade 500 includes various connectors for engagement with a base 606 to couple the spade 500 to the base 606 without hardware. The connectors include snap-catch windows 708 that will receive and engage with corresponding snap connectors 812 on the base 606. There is a generous lead-in portion 710 in front of each window 708 that helps facilitate the snap engagement. A retaining tab 714 is configured to engage a lower edge 816 of the base 606 to limit vertical movement of the spade 500 relative to the base 606 and aid in keeping the spade 500 from separating from the base 606. A paddle snap 718 engages an aperture 820 in the base 606 when the spade 500 is coupled to the base 606 to lock the spade 500 into its final assembled position on the base 606. Although the spade 500 is illustrated having all three types of connectors, i.e. windows 708, retaining tab 714 and paddle snap 718, in various embodiments less than all three types of connectors are included. Additionally, more or fewer, of each type of connector may be included in various embodiments of the spade 500, as can other types of connectors.

The spade 500 may also include aligning elements to engage corresponding features on the base 606 to align and guide the spade 500 relative to the base 606 when the spade 500 is coupled to the base 606 without hardware. These aligning elements include vertical walls 722 and horizontal ribs 724. The vertical walls 722 align with and are received between corresponding walls 826 on the base 606. The horizontal ribs 724 define an opening 730 into which a base rib 828 on the base 606 fits. Thus, when installing the spade 500 on the base 606, these aligning features help guide the spade 500 horizontally and vertically into the correct installed position. After installation of the spade 500, the aligning features further inhibit movement of the spade 500 relative to the base 606.

To couple the spade 500 to the base 606, the spade 500 is moved toward the base 606 with the spade 500 in a position, relative to the base 606, that is somewhat lower than the final installed position. In this lower position, the retaining tab 714 is below the lower edge 816, allowing the spade 500 to be moved into contact with a wall 830 of the base 606. The horizontal ribs 724 and the lead-in portions 710 help align the spade 500 to the correct vertical position relative to the base 606. The vertical walls 722 and the corresponding walls 826 on the base 606 help align the spade 500 to the correct horizontal location on the base 606. As the spade 500 is moved toward the wall 830, the snap connectors 812 engage the lead-in portions 710 and begin to deflect away from the center of the spade 500. Once the snap connectors 812 pass through the snap-catch windows 708, they move, or snap, back toward the center and hold the spade 500 to the base 606. The snap-catch windows 708 are taller than the snap connectors 812, allowing the spade 500 to slide up even while the snap connectors 812 are connecting the spade 500 to the base 606. After snap connectors 812 are so engaged, the user slides the spade 500 upward until a horizontal surface 732 contacts a bottom surface 634, best seen in FIG. 6*b*, of the base 606.

As the spade 500 is slid upward, the horizontal ribs 724 are moved into position behind the snap connectors 812. In the final installed position, the horizontal ribs 724 are located behind the snap connectors 812 to prevent the snap connectors 812 from deflecting outwardly and releasing the spade 500 from the base 606. This is aided by upwardly extending foot ribs 736 located on ends the horizontal ribs 724. The foot ribs 736 provide a larger surface for engaging the snap connectors 812 and inhibiting the snap connectors 812 from deflecting outwardly and decoupling from the snap-catch windows 708.

Additionally, sliding the spade 500 upward moves the retaining tab 714 into its final position. As the spade is pushed upward, the retaining tab 714 moves upward and engages the lower edge 816 of the base 606. The retaining tab 714 thus limits separation of the spade 500 away from the lower edge 816 of the base 606 in a horizontal direction.

Finally, the upward sliding of the spade 500 causes the paddle snap 718 to engage the aperture 820. Because the paddle snap 718 includes a protruding button 738, the paddle snap deflects away from the base 606 when the spade is brought toward the base 606 and into contact with the wall 830. When the spade 500 is slid upward to the point where the horizontal surface 732 meets the bottom surface 634 of the base 606, the button 738 aligns with and, due to its resilient nature, snaps into the aperture 820 in the wall 830 of the base 606. Through this engagement with the aperture 820, the paddle snap 718 inhibits sliding movement of the spade 500 relative to the base 606 in a vertical direction.

In the final installed position, the various connectors and aligning elements hold the spade 500 coupled securely to the base 606. The snap connectors 812 and the retaining tab 714 inhibit separation of the spade 500 from the base 606. The horizontal ribs 724, and more particularly the foot ribs 736, prevent deflection of the snap connectors 812, which would permit the spade 500 to separate from the base 606. Finally, the paddle snap 718 prevents the spade 500 from being moved down or up relative to the base 606. This prevents the retaining tab 714 from disengaging from the edge 816 and prevents the foot ribs 736 from being moved away from the position preventing deflection of the snap connectors 812.

The spade 500 may be removed from the base 606 by reversing the installation operations. Specifically, the button 738 on the paddle snap 718 is forced back through the hole 820, thereby deflecting the paddle snap 718 away from the base 606. The spade 500 can then be moved downward, disengaging the retaining tab 714 and moving the foot ribs 736 downwardly and away from the snap connectors 812. The snap connectors 812 are than forced, by the user, to deflect away from each other so that the spade 500 can be removed from the base 606.

The base 14, i.e., the first and second wall structures 30 and 34, the base 606, the spade 114 and the spade 500 can be constructed of any suitable metallic or non-metallic material. Accordingly, they can be formed using any suitable means of fabrication, such as casting or molding. For example, in various embodiments, the base 14 or 606, the spade 500 and/or the spade 114 can be injection molded using any suitable non-metallic plastic or compound, e.g., a glass filled polymer. Additionally, in various embodiments, the spade 114 or the spade 500 can be fabricated as, or fabricated to include, an electrical grounding source to electrically ground the pedestal 10.

Certain terminology is used herein for purposes of reference only, and thus is not intended to be limiting. For example, terms such as "upper", "lower", "above", "below", "top", "bottom", "upward", and "downward" refer to directions in the drawings to which reference is made. Terms such as "front", "back", "rear", "bottom" and "side" describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

The description herein is merely exemplary in nature and, thus, variations that do not depart from the gist of that which is described are intended to be within the scope of the teachings. Such variations are not to be regarded as a departure from the spirit and scope of the teachings.

What is claimed:

1. A spade for hardware free mounting to a telecommunications pedestal base, the spade comprising:

a lower section for insertion into ground; and an upper section located above the lower section for coupling the spade to the pedestal base, the upper section including at least a first connector for engagement with the pedestal base to couple the spade to the pedestal base without hardware, the first connector configured to engage a mating connector on the pedestal base to inhibit separation of the spade from the pedestal base when the spade is coupled to the pedestal base.

2. The spade of claim 1 wherein the first connector is configured for releasable engagement with the mating connector on the pedestal base.

3. The spade of claim 1 wherein the upper section includes a plurality of aligning elements for aligning the spade with the pedestal base.

4. The spade of claim 3 wherein the aligning elements are configured to interact with corresponding aligning elements on the pedestal base to align the spade on the pedestal base when the spade is coupled to the pedestal base.

5. The spade of claim 1 wherein the lower section includes a drive surface for receiving a force to drive the lower section into ground.

6. The spade of claim 1 wherein the first connector includes a window and the mating connector is a snap connector, the window configured to receive the snap connector when the spade is coupled to the pedestal base.

7. The spade of claim 1 further comprising a second connector to inhibit vertical movement of the spade relative to the pedestal base when the spade is coupled to the pedestal base.

8. The spade of claim 7 wherein the second connector includes a paddle snap for engaging an aperture in the pedestal base when the spade is coupled to the pedestal base.

9. The spade of claim 7 further comprising a third connector for further limiting vertical movement of the spade relative to the pedestal base and further limiting separation of the spade from the pedestal base when the spade is coupled to the pedestal base.

10. The spade of claim 9 wherein the third connecter includes a retaining tab for engaging an edge of the pedestal base when the spade is coupled to the pedestal base.

11. A spade for hardware free mounting to a telecommunications pedestal base, the spade comprising:

a lower section for insertion into ground; and an upper section located above the lower section for coupling the spade to the pedestal base, the upper section including at least a first connector for engagement with the pedestal base to couple the spade to the pedestal base without hardware, wherein the first connector includes a paddle snap for engaging an aperture in the pedestal to inhibit vertical movement of the spade relative to the pedestal base when the spade is coupled to the pedestal base.

12. The spade of claim 11 wherein the upper section of the spade includes a second connector, the second connector of the spade including a retaining tab for engaging an edge of the pedestal base to limit vertical movement of the spade relative to the pedestal base and separation of the spade from the pedestal base when the spade is coupled to the pedestal base.

13. A spade for hardware free mounting to a telecommunications pedestal base, the spade comprising:

a lower section for insertion into ground; and an upper section located above the lower section for coupling the spade to the pedestal base, the upper section including at least a first connector for engagement with the pedestal base to couple the spade to the pedestal base without hardware, wherein the first connector includes a retaining tab for engaging an edge of the pedestal base to limit vertical movement of the spade relative to the pedestal base and separation of the spade from the pedestal base when the spade is coupled to the pedestal base.

14. The spade of claim 13 wherein the upper section of the spade includes a second connector, the second connector of the spade configured to engage a mating connector on the pedestal base to inhibit separation of the spade from the pedestal base when the spade is coupled to the pedestal base.

15. A telecommunications pedestal base comprising a spade mounting portion for hardware free mounting of a spade to the pedestal base, the spade mounting portion including at least a first connector for engagement with the spade to couple the spade to the pedestal base without hardware, the first connector of the spade mounting portion configured to couple to a first mating connector on the spade to inhibit separation of the spade from the pedestal base when the spade is coupled to the pedestal base.

16. The pedestal base of claim 15 wherein the first connector of the spade mounting portion is configured to releasably engage the first mating connector on the spade when the spade is coupled to the pedestal base.

17. The pedestal base of claim 15 further comprising at least one aligning element for aligning the spade with the pedestal base when the spade is coupled to the pedestal base.

18. The pedestal base of claim 15 wherein the spade mounting portion includes a second connector configured to receive a second mating connector on the spade to inhibit vertical movement of the pedestal base relative to the spade when the spade is coupled to the pedestal base.

19. A telecommunications pedestal assembly comprising a telecommunications pedestal and a spade, the spade including a lower section for insertion into ground and an upper section above the lower section, the upper section including a first connector, the pedestal including a first mating connector, the first connector of the spade engaged with the first mating connector of the pedestal to attach the spade to the pedestal without separate mounting hardware.

20. The assembly of claim 19 wherein the first connector of the spade is releasably engaged with the first mating connector of the pedestal.

21. The assembly of claim 19 wherein the lower section includes a drive surface for receiving a force to drive the lower section into ground.

22. The assembly of claim 19 wherein the first mating connector of the pedestal is a snap connector and the first connector of the spade includes a window receiving the snap connector.

23. The assembly of claim 19 wherein the upper section of the spade includes a second connector to inhibit vertical movement of the spade relative to the pedestal.

24. The assembly of claim 23 wherein the second connector of the spade includes a paddle snap engaging an aperture in the pedestal base.

25. The assembly of claim 23 wherein the upper section of the spade includes a third connector for further limiting vertical movement of the spade relative to the pedestal base.

26. The assembly of claim 25 wherein the third connecter of the spade includes a retaining tab engaging an edge of the pedestal.

27. A spade for hardware free mounting to a telecommunications pedestal base having at least one snap connector, a lower edge and an aperture, the spade comprising:

a lower section for insertion into ground; and an upper section located above the lower section for coupling the spade to the pedestal base, the upper section including at least one connector of a first type for engaging said snap connector, at least one connector of a second type for engaging said lower edge, and at least one connector of a third type for engaging said aperture to couple the spade to the pedestal base without hardware.

28. The spade of claim 27 wherein the first type is a snap-catch window, the second type is retaining tab, and the third type is a paddle snap.

29. The spade of claim 28 wherein the pedestal base includes a plurality of snap connectors and the at least one connector of the first type includes a plurality of snap-catch windows for engaging said plurality of snap connectors.

30. The spade of claim 29 further comprising a drive surface for receiving a force to drive a lower section of the spade into ground.

* * * * *